United States Patent [19]

Kotzab et al.

[11] Patent Number: 4,840,150

[45] Date of Patent: Jun. 20, 1989

[54] VALVE-ACTUATING LEVER FOR INTERNAL COMBUSTION ENGINES

[75] Inventors: Werner Kotzab, Schweinfurt; Horst Zielke, Winnenden, both of Fed. Rep. of Germany

[73] Assignee: Daimler-Benz Aktiengesellschaft, Stuttgart, Fed. Rep. of Germany

[21] Appl. No.: 193,671

[22] Filed: May 12, 1988

[30] Foreign Application Priority Data

May 12, 1987 [DE] Fed. Rep. of Germany ..... 3715758

[51] Int. Cl.[4] ..... F01L 1/18

[52] U.S. Cl. ..... 123/90.39; 123/90.44

[58] Field of Search ..... 123/90.27, 90.39, 90.44, 123/90.51

[56] References Cited

U.S. PATENT DOCUMENTS 4,438,738 3/1984 Kosuda et al. .
4,624,223 11/1986 Wherry et al. ..... 123/90.44
4,643,144 2/1987 Fingerle et al. ..... 123/90.39
4,672,927 6/1987 Uchida ..... 123/90.44
4,738,231 4/1988 Patel et al. ..... 123/90.44

FOREIGN PATENT DOCUMENTS 2819356 11/1979 Fed. Rep. of Germany ... 123/90.44
3342275 5/1985 Fed. Rep. of Germany ... 123/90.44

*Primary Examiner*—Charles J. Myhre
*Assistant Examiner*—Weilun Lo
*Attorney, Agent, or Firm*—Barnes & Thornburg

[57] ABSTRACT

A valve-actuating lever for internal combustion engines with a slide member disposed in a rectangular groove which is form-lockingly retained at the lever member by at least two strips within the area of the forward and rear edge in relation to the direction of rotation of the cam shaft, whereby the lever member is provided with undercuts within the area of the rectangular groove; the strips thereby consist of fiber-reinforced plastic material with a temperature resistance of at least 150° C. and form-lockingly surround the undercuts of the lever member as well as the forward and rear edge of the slide body in relation to the direction of rotation. It is preferred if the strips are constructed as closed frame.

5 Claims, 2 Drawing Sheets

VALVE-ACTUATING LEVER FOR INTERNAL COMBUSTION ENGINES

BACKGROUND AND SUMMARY OF THE INVENTION

The present invention relates to a valve-actuating lever for internal combustion engines with a slide body disposed in a rectangular groove which is form-lockingly retained at the lever member by at least two strips within the area of the forward and rear edge in relation to the direction of rotation of the cam shaft.

Valve-actuating levers in which the slide surface is formed by a separate slide body, offer the advantage that the respectively suited material can be used for the lever member and the contact surface. Thus, a tough material with high strength can be selected for the lever member, for example, steel, aluminum- or magnesium-alloys, whereas the slide body or slide stone can consist of a material with high wear resistance, for example, oxide or nitride ceramics, cermets or sintered hard metals (cemented carbide).

The fastening of the slide body on the lever member takes place ordinarily by casting-in or by brazing or adhesion (DE-AS No. 17 76 084). All of these methods have special advantages and disadvantages.

It is known from the DE-PS No. 33 42 275 to retain a slide body which is adhesively fastened in a rectangular groove of the lever member, at the lever member by at least two strips. This fastening is relatively costly because the strips must be welded to the lever member to assure a sufficient durability.

The object of the present invention resides in providing a valve-actuating lever with slide body adapted to be manufactured in a simple and price-favorable manner, in connection with which adhesion or welding can be dispensed with.

The underlying problems are solved according to the present invention in that the lever member is provided within the area of the rectangular groove with projections and in that the strips consist of fiber-reinforced or ceramic-powder or glass microballs containing plastic material with a temperature resistance of at least 150° C. and form-lockingly surround the projections of the lever member as well as the forward and rear edges of the slide body in relation to the direction of rotation of the cam shaft.

The slide body consists of a high wear-resistant material, for example, oxide- or nitride-ceramics. The slide surface of the slide body is constructed cylindrically. The slide body is disposed in a rectangular groove of the lever member. It is form-lockingly retained in this groove by at least two strips within the area of the forward and rear edge in relation to the direction of rotation. The strips consist of a fiber-reinforced or ceramic-powder or glass microballs containing plastic material with a temperature resistance of at least 150° C. For purposes of anchoring the strips, the lever member is provided with projections within the area of the rectangular groove. The strips form-lockingly surround these projections of the lever member as well as the forward and rear edges of the slide body in relation to the direction of rotation of the cam shaft.

The strips consist of fiber-reinforced or ceramic-powder or glass microballs containing plastic material. Plastic materials which have the necessary thermal stability of 150° C. as well as a corresponding resistance against the motor vehicle fuels are, for example, thermoplastic materials such as polyimides, phenylene oxides or fluoroplastics or polymer-cement, polyphenylenesulfides, polysulfones, etc. In addition to the thermoplastic materials, also cross-linked plastic resins can be used, such as, for example, phenyl- or epoxy-resins, etc. Additionally, filled elastomers as well as compounds of thermo+-duroplastic (thermosetting) materials+elastomers are suited. The plastic materials are reinforced with fibers in order to assure a sufficient service life. Inorganic fibers such as glass fibers, carbon fibers or whiskers can be used in the first instance as fibers. The fibers are appropriately present already in the resin mass in the form of short fibers. It is particularly advantageous for an economic manufacture and large production number to mold-on the strips at the lever member provided with inserted slide body according to the injection-molding process.

In order to assure a sufficient anchoring of the plastic material at the lever member, the latter is provided with projections which are form-lockingly surrounded by the strips. The rectangular groove in the lever member can thereby be constructed, on the one hand, cup-like with edges of the projections protruding out of the lever member and may have undercuts at the outside walls of the edges, however, it is also possible that the projections of the lever member have the undercuts at the inner sides of the rectangular groove. In the latter case, the strip is disposed between the inner edge of the lever member and the slide body. It may thereby be additionally supported at the inner edge of the rectangular groove of the lever member. In case the undercuts are provided at the outer walls of the edge of the rectangular groove, it is appropriate if the strips are constructed as endless or closed frame or cage. For purposes of improved anchoring of the strips, both the lever member as also the slide body may be provided with additional anchoring bores.

BRIEF DESCRIPTION OF THE DRAWINGS

These and other objects, features and advantages of the present invention will become more apparent from the following description when taken in connection with the accompanying drawing which shows, for purposes of illustration only, two embodiments in accordance with the present invention, and wherein.

DETAILED DESCRIPTION OF THE DRAWINGS

Figure 1:
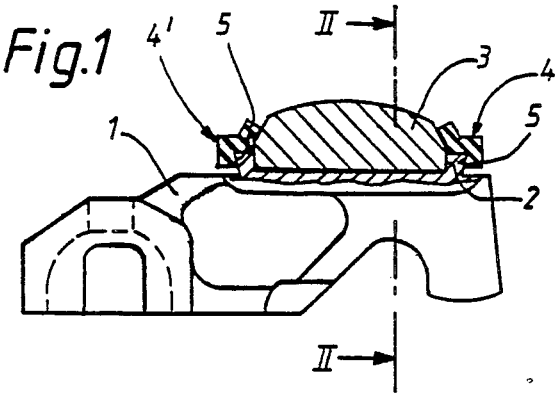
FIG. 1 is a cross-sectional view though a valve-actuating lever in accordance with the present invention.
Figure 2:
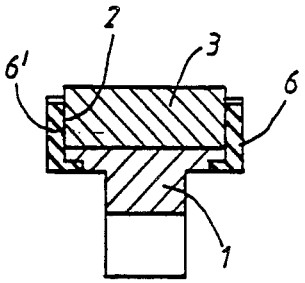
FIG. 2 is a cross-sectional view taken along line II—II through the valve-actuating lever according to FIG. 1.
Figure 3:
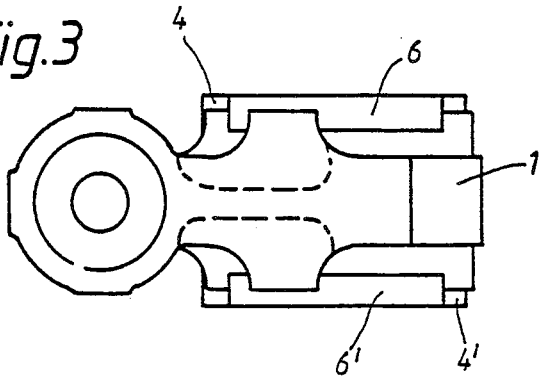
FIG. 3 is a bottom plan view on the valve-actuating lever according to FIG. 1.

Referring now to the drawing wherein like reference numerals are used throughout the various views to designate like parts, and more particularly to FIG. 1, this figure illustrates a longitudinal cross section through a valve-actuating lever. The slide body 3 is disposed in a rectangular groove 2 of the lever member 1. The rectangular groove 2 is constructed cup-shaped and is provided with projections 5, respectively, 5' at the two oppositely disposed sides. The plastic material strips 4 and 4' surround these projections and fix the slide member 3 in the rectangular groove. The two strips 4 and 4' are, as illustrated in Figure 2, connected with each other by means of the frame-like plastic material parts 6 and 6'. The frame parts 6 and 6' serve at the same time for the lateral fixing of the slide member 2 so that a lateral sliding out of the slide member out of the rectangular groove is avoided. For increasing the rigidity, the frame parts 6 and 6' are drawn laterally about the lever member. FIG. 3 illustrates the valve-actuating lever of FIGS. 1 and 2 as viewed from below. One can recognize the lever member 1, the frame parts 6 and 6' drawn about the lever member as well as the ends of the plastic strips 4 and 4'.

Figure 4:
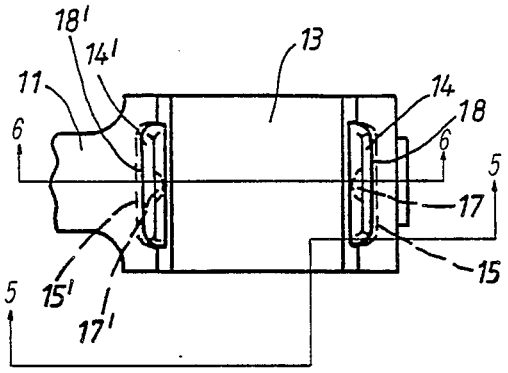
FIG. 4 is a plan view on a part of a valve-actuating lever with "inwardly disposed" strip according to the present invention.
Figure 5:
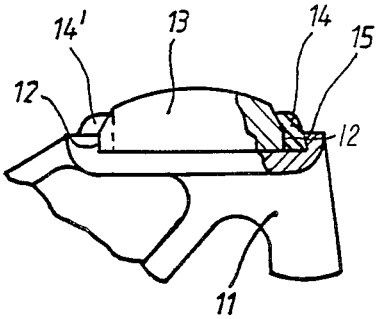
FIG. 5 is a partial side view of the lever taken along line 5—5 according to FIG. 4.
Figure 6:
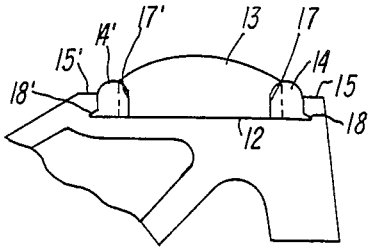
FIG. 6 is a sectional, plan view taken along line 6—6 of FIG. 4, illustrating the configuration of the recesses and cavities of the lever.

FIGS. 4 and 5 illustrate a different possibility of the fastening of the slide body at the lever member. The slide body 13 is again located in the rectangular groove 12. The rectangular groove 12 is provided with cavities 18 and 18' whereby the cavities 18 and 18' are provided internally of projections 15 and 15' (shown in dash line in FIG. 4). The slide body 13 is retained in the rectangular groove 12 by the plastic strips 14 and 14' in conjunction with the projections 15 and 15'. The slide body 13 is provided with recesses 17 and 17' as safety against a lateral displacement of the slide body 13 in the rectangular groove 12 which serve additionally the further fastening of the slide body 13. In principle, the plastic strips 14 and 14' may, of course, also extend over the entire width of the lever member.

The plastic strips, respectively, the plastic frame is customarily molded-on in a suitable device at the lever member provided with the slide body. However, it is also possible to make the frame of a hardening (thermosetting) fiber-reinforced or ceramic powder or glass microballs containing plastic resin. The latter process can also be carried out manually and is suited in particular for smaller series and single piece productions. Synthetic resins may also be used in connection therewith which exert no special adhesive effect on the lever member or the rectangular groove because the connection of slide and lever member takes place form-lockingly and the force transmission is not predicated on adhesion as with the usual adhesive connections but on the shear strength of the utilized synthetic resin.

While we have shown and described only two embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A valve-actuated lever, comprising slide means disposed in a rectangular groove of a lever means, the slide means being form-lockingly retained in the lever means by at least two strip means within the area of forward and rear edges of the slide means, the forward and rear edges being formed relative to the central axis of a cam shaft, the lever means being provided with projections within the area of the rectangular groove, the slide means having a pair of recesses, the respective recesses being formed in the forward and rear edges of the slide means and adjacent to forward and rear edges of the groove, wherein the strip means are at least equal in length to the respective recesses, and project into cavities formed in the lever means beneath the respective forward and rear edges of the groove, and the strip means include at least one of a fiber-reinforced plastic material, ceramic-powder containing plastic material and glass microballs containing material, each with a temperature resistance of at least 150° and form-lockingly filling the pair of recesses and respective cavities.

2. A valve-actuating lever according to claim 1, wherein the rectangular groove is contructed cup-like with the edges of the projections protruding out of the lever means.

3. A valve-actuating lever according to claim 1, wherein the projections of the lever means are provided with undercuts at the inside walls of the rectangular groove.

4. A valve-actuating lever according to claim 2, wherein the strip means are constructed as closed frame.

5. A valve-actuating lever according to claim 1, wherein the strip means are constructed as closed frame.

* * * * *